US006135823A

United States Patent [19]

Torii

[11] Patent Number: 6,135,823

[45] Date of Patent: Oct. 24, 2000

[54] SUBSTRATE CONNECTOR

[75] Inventor: Chieko Torii, Shizuoka-ken, Japan

[73] Assignee: Yazaki Corporation, Tokyo, Japan

[21] Appl. No.: 09/276,488

[22] Filed: Mar. 25, 1999

[30] Foreign Application Priority Data

Mar. 27, 1998 [JP] Japan ..... 10-081946

[51] Int. Cl.[7] ..... H01R 13/502

[52] U.S. Cl. ..... 439/686; 439/58

[58] Field of Search ..... 439/686, 82, 79, 439/83

[56] References Cited

U.S. PATENT DOCUMENTS 5,580,283 12/1996 O'Sullivan et al. ..... 439/686

FOREIGN PATENT DOCUMENTS 3-11566 1/1991 Japan .

*Primary Examiner*—Neil Abrams
*Assistant Examiner*—Eugene G. Byrd
*Attorney, Agent, or Firm*—Oblon, Spivak, McClelland, Maier, Neustadt, P.C.

[57] ABSTRACT

A disclosed substrate connector comprises a terminal including a contact portion contacting with a mated terminal and a fixed portion fixed to a substrate, and a housing including a housing main body and a spacer member. Here, the housing main body includes a first opening portion which is provided on one side of the housing main body and from which the fixed portion of the terminal is led outside, a second opening portion which is provided on the other side of the housing main body and into which the mated terminal is inserted, and a terminal accommodating chamber accommodating both of the terminal and the mated terminal and provided between the first opening portion and the second opening portion, and the spacer member is attached to the first opening portion of the housing main body. Also, a portion between the contact portion of the terminal and the fixed portion of the terminal is held by a portion in which the spacer member and an inner wall of the terminal accommodating chamber are opposed to each other.

12 Claims, 8 Drawing Sheets

SUBSTRATE CONNECTOR

BACKGROUND OF THE INVENTION

The present invention relates to a substrate connector and relates to, in particular, a substrate connector connecting to a substrate on which a circuit is formed and connecting to a mated connector which connects to a mated substrate, to thereby connect both of the substrates to each other.

Japanese Patent Application Laid-open No. 3-11566 discloses a substrate connector directly fixed to a substrate on which a circuit is formed and connecting two substrates.

The substrate connector of this type is constituted by a housing to be fixed to a substrate and terminals contained in the housing.

SUMMARY OF THE INVENTION

The inventor of the present invention analyzed the substrate connector of this type. According to the analysis, terminal accommodating chambers are formed in a housing to be fixed to a substrate and one end of a terminal is accommodated in each of the terminal accommodating chambers.

As for the substrate connector of this type, there are many cases where one end of the terminal is provided with a contact portion contacting with a mated terminal and the other end thereof is provided with a soldering fixed portion passing through the substrate and fixedly soldered to the back surface of the substrate.

It is recognized that the terminal has, for example, a structure in which a bent stress absorbing portion is provided between the contact portion and the soldering fixed portion. With this structure, when the terminal is connected to the mated terminal, a force applied to the substrate in the perpendicular direction is absorbed by this stress absorbing portion, thereby making it possible to prevent the force from being directly applied to the soldering portion on the back surface of the substrate.

According to such a substrate connector, however, while a force applied to the substrate in the perpendicular direction of the substrate can be effectively absorbed by the stress absorbing portion, a force along the surface direction of the substrate is directly applied to the soldering fixed portion. Due to this, there is fear that a crack or the like occurs to the soldering fixed portion and that the function of an electric circuit structured through the substrate connector is not exhibited as designed.

The present invention has been made based on the analysis made by the inventor of the present invention. It is, therefore, an object of the present invention to provide a substrate connector preventing a force from being directly applied to the soldering fixed portion of the substrate connector.

To attain the above object, a substrate connector according to the present invention comprises a terminal including a contact portion contacting with a mated terminal and a fixed portion fixed to a substrate, and a housing including a housing main body and a spacer member. Here, the housing main body includes a first opening portion which is provided on one side of the housing main body and from which the fixed portion of the terminal is led outside, a second opening portion which is provided on the other side of the housing main body and into which the mated terminal is inserted, and a terminal accommodating chamber accommodating both of the terminal and the mated terminal and provided between the first opening portion and the second opening portion, and the spacer member is attached to the first opening portion of the housing main body. Also, a portion between the contact portion of the terminal and the fixed portion of the terminal is held by a portion in which the spacer member and an inner wall of the terminal accommodating chamber are opposed to each other.

With this structure, since the portion between the contact portion and the fixed portion of the terminal is held between the inner wall of the terminal accommodating chamber and the spacer member, due to this, even if a force along a direction perpendicular to the substrate, that is, a force in a fitting direction in which the terminal and the mated terminal of a mated connector are fitted together is applied, and further, even if a force along the surface direction of the substrate is applied to adjust the relative positions at a time the terminal and the mated terminal of the mated connector are fitted together, such a force is not directly applied to the fixed portion. Thus, it is possible to effectively prevent a crack or the like from occurring to the fixed portion of the terminal.

Needless to say, the fixed portion of the terminal may be a soldering fixed portion.

More specifically, the housing main body may include a fixed portion fixed to the substrate on each of both sides of the housing main body. More specifically, the fixed portion may be provided on each of longitudinal both sides of the housing main body.

With this structure, the housing main body is fixed to the substrate by means of the fixed portions. In addition, a force, which is applied to the housing main body while the connector and the mated connector is fitted together, is received by the substrate through the fixed portions. Thus, occurrence of cracks or the like to the fixed portions fixed to the substrate can be effectively prevented.

Meanwhile, the spacer member may include a fixed portion fixed to the substrate on each of both sides of the spacer member. More specifically, the fixed portion of the spacer member may be provided on each of longitudinal both sides of the spacer member.

With this structure, since the spacer member is fixed to the substrate by the fixed portions, the spacer member can be incorporated into the housing main body with the spacer member fixed to the substrate in advance. As a result, operability enhances during attachment operation.

With the structure in which the fixed portion fixed to the substrate is provided on each of longitudinal both sides of the spacer member, the spacer member preferably includes a pair of flexible plates supporting both sides of the housing main body, respectively, while allowing the housing main body to move in a direction connecting the fixed portions of the spacer member with each other.

With this structure, due to the flexibility of the flexible plates, the housing main body is allowed to move in the direction connecting the fixed members with each other. It is, therefore, possible to carry out good attachment operation by compensating for any positional shift when the mated connector is attached.

Further, with the structure in which the fixed portion fixed to the substrate is provided on each of longitudinal both sides of the spacer member, it is preferable that the spacer member includes a pair of retaining protrusions corresponding to the fixed portions of the spacer member, respectively, and that the housing main body includes a pair of retaining protrusions retained corresponding to the pair of retaining protrusions of the spacer member and a pair of flexible locking arm portions provided with the retaining protrusions, respectively, for allowing the housing main body to move in the direction crossing the direction connecting the fixed portions of the spacer member with each other.

With this structure, due to the flexibility of the flexible locking arm portions, the housing main body is allowed to move in a direction crossing the direction connecting the fixed portions with each other. Thus, it is possible to carry out good attachment operation by compensating for any positional shift when the mated connector is attached. Besides, the engagement of the retaining protrusions with each other ensures that the housing main body is retained by the spacer member.

More specifically, in this case, the direction crossing the direction connecting the fixed portions of the spacer member with each other is a direction substantially orthogonal to the direction connecting the fixed portions of the spacer member with each other.

Further, more specifically, it is preferable that the pair of flexible plates of the spacer member are formed integrally with the fixed portions so as to be opposed to the longitudinal side surfaces of the housing main body, respectively, that the pair of retaining protrusions of the spacer member are provided to each of the fixed portions on both sides in the direction crossing the direction connecting the fixed portions of the spacer member with each other, that the pair of flexible locking arm portions of the housing main body are provided on each of the longitudinal side surfaces of the housing main body on both sides in the direction crossing the direction connecting the fixed members of the spacer member with each other so as to be opposed to each other, and that the pair of retaining protrusions of the housing main body are provided at the pair of flexible locking arm portions, respectively, so as to be opposed to each other.

With this structure, since it is ensured that the housing main body is allowed to move during attachment operation, due to this, even if the mated connector is slightly shifted from a normal fitting position, the shift is compensated and good fitting operation can be carried out. Besides, the engagement of the retaining protrusions with each other ensures that the housing main body is retained by the spacer member.

According to the substrate connector of the present invention, the housing main body may include an inner wall for positioning the spacer member attached into the housing main body.

With this structure, at a time of incorporating the spacer member into the housing main body, if the spacer member is inserted from the insertion opening, the inner wall of the housing main body abuts against the spacer member and the insertion position of the spacer member is determined. Thus, good assembly operation can be realized.

According to the substrate connector of the present invention, the terminal may include an abutting portion abutting on the substrate. The abutting portion is preferably formed by cranking the terminal between the contact portion of the terminal and the fixed portion of the terminal.

With this structure, even if a force in a direction perpendicular to the substrate is applied to the terminal while the connector and the mated connector are fitted together, the force is received by the substrate due to the fact that the abutting portion surely abuts on the substrate. Thus, the force is not directly applied to the fixed portion fixed by, for example, soldering on the tip end side of the abutting portion and defects such as crack do not occur to the fixed portions.

DESCRIPTION OF THE PREFERRED EMBODIMENTS

The embodiments of the present invention will now be described in detail with reference to the accompanying drawings.

First, description will be given to a substrate connector in the first embodiment according to the present invention with reference to FIGS. 1A, 1B through 3.

Figure 1A:
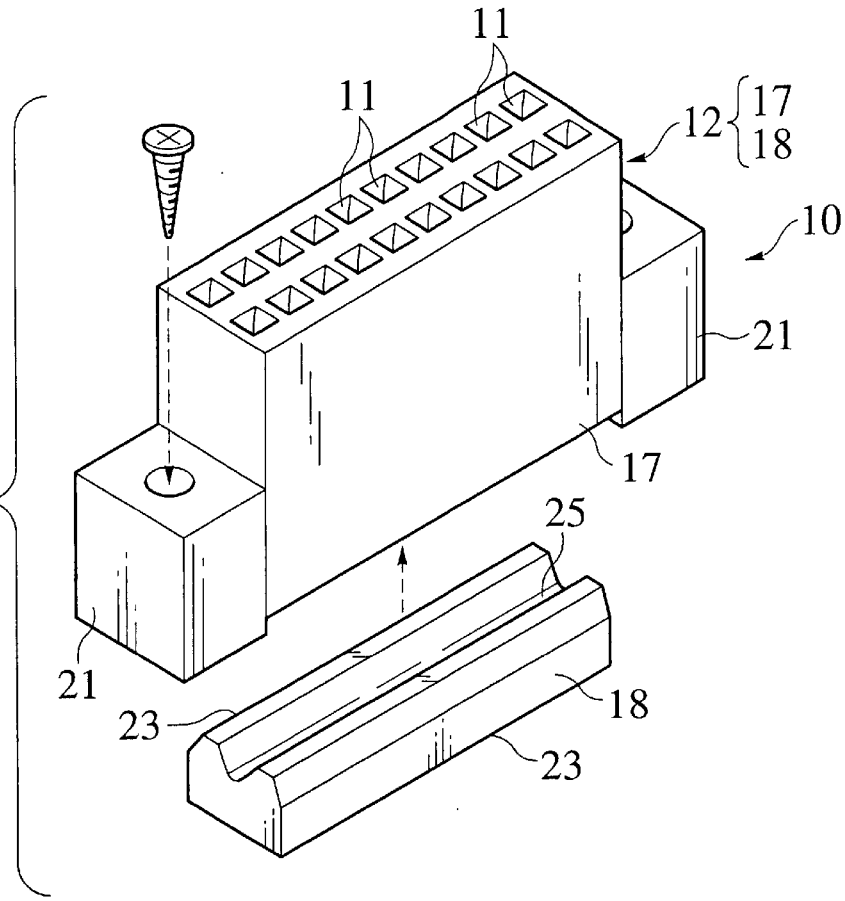
FIG. 1A is a perspective exploded view of a substrate connector in the first embodiment according to the present invention.
Figure 1B:
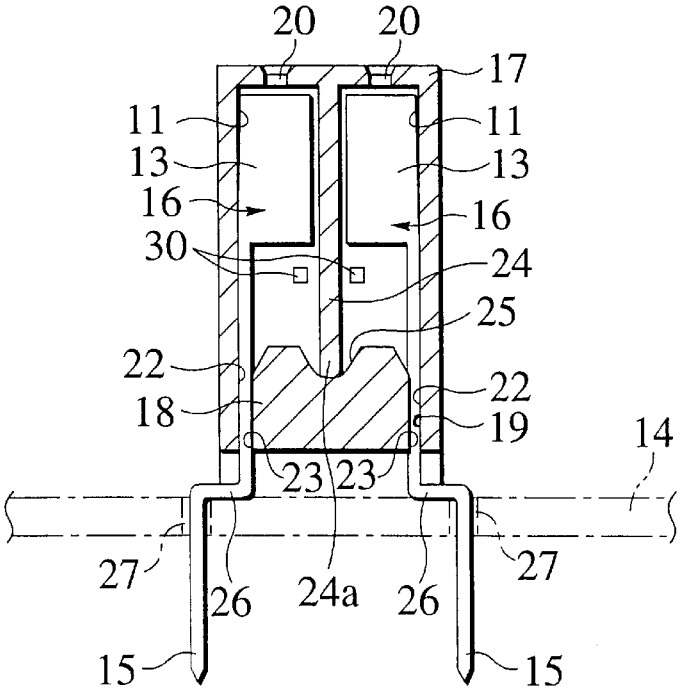
FIG. 1B is a cross-sectional view showing a state in which the substrate connector is fixed onto a substrate in this embodiment.

As shown in FIGS. 1A and 1B, a substrate connector 10 is provided with a housing 12 having a plurality of terminal accommodating chambers 11 formed therein and terminals 16. Each of the terminals 16 has a contact portion 13 accommodated in each of the terminal accommodating chambers 11 and connected to a mated terminal, and has a fixed portion 15 fixedly soldered to a substrate 14. The substrate connector 10 is directly attached onto the substrate 14.

The housing 12 is constituted by a housing main body 17 having the terminal accommodating chambers 11 respectively partitioned by partition inner walls 24 into two lines and a spacer member 18 attached and incorporated into the housing main body 17.

The one side of housing main body 17 is provided with an assembly opening 19 from which the soldering fixed portion 15 of the terminal 16 is drawn outside and the other side of the housing main body 17 is provided with insertion openings 20 from each of which a mated terminal to be connected to the terminal 16 is inserted into each of the terminal accommodating chambers 11. Fixed portions 21 and 21 fixed to the substrate 14 are provided integrally with the housing main body 17 on longitudinal both sides of the housing main body 17, respectively. From the assembly opening 19 of the housing main body 17, each of the terminals 16 is inserted into the corresponding terminal accommodating chamber 11 and the spacer member 18 is inserted also, as well.

The spacer member 18 is a substantially rectangular parallelopiped and includes, on both sides, holding surfaces 23 and 23 for holding terminals 16 between the holding surfaces 23, 23 and inner walls 22, 22 of the terminal accommodating chambers 11, respectively. An abutting groove 25 against which a lower portion 24*a* of a partition inner wall 24 partitioning the terminal accommodating chambers 11 within the housing main body 17 abuts is provided on the upper surface of the spacer member 18. The position at which the spacer member 18 is inserted into the housing main body 17 is determined by abutting the lower portion 24*a* of the partition inner wall 24 against the abutting groove 25.

The contact portion 13 for contacting with the mated terminal is provided on one end of the terminal 16 and the soldering fixed portion 15 passing through the substrate 14 and fixedly soldered to the back surface of the substrate 14, is provided on the other end of the terminal 16. An abutting portion 26, which is cranked and abuts on the substrate 14, is provided between the contact portion 13 and the soldering fixed portion 15.

As shown in FIG. 1B, while the terminal 16 and the spacer 8 member 18 are incorporated into the housing main body 17, the contact portion 13 is contained in the terminal accommodating chambers 11 and a portion between the abutting portion 26 and the contact portion 13 is held between the holding surface 23 of the spacer member 18 and the inner wall 22 of the housing main body 17. When each of the fixed portions 21 is fixed onto the substrate 14, each of the abutting portions 26 abuts on the substrate 14 and each of the soldering fixed portions 15 drawn out from the assembly opening 19 of the housing main body 17 is inserted into corresponding one of through holes 27 of the substrate 14. The soldering fixed portion 15 inserted into the through hole 27 is fixedly soldering to the back surface of the substrate 14.

Figure 2:
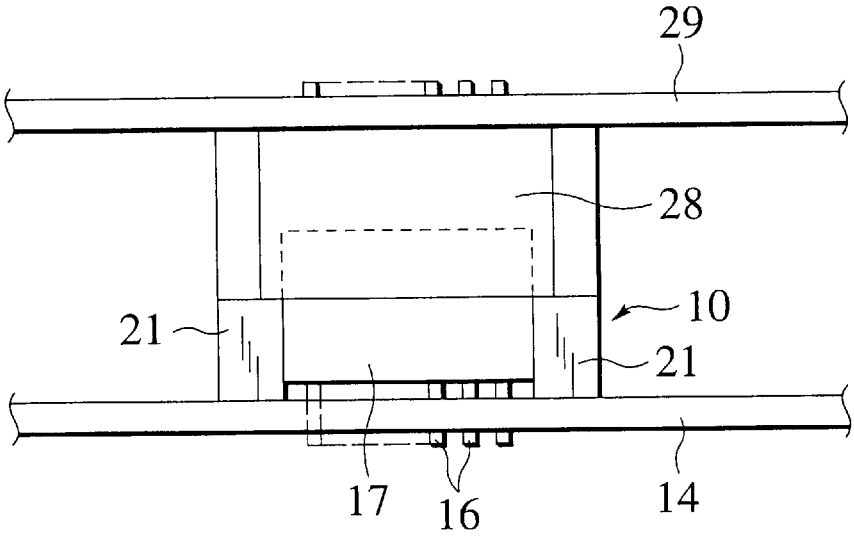
FIG. 2 is a side view showing a state in which the substrate connector is fitted into a mated connector in this embodiment.

In this state, as shown in FIG. 2, the substrate connector 10 is fitted into a mated connector 28, whereby a substrate 29 to which the mated connector 28 is directly attached is electrically connected to the substrate 14.

At this moment, a force applied to the terminal 16 in a fitting direction (a force in a direction perpendicular to the substrate 14) is not directly applied to the soldering fixed portion 15, since the terminal 16 is held between the holding surface 23 of the spacer member 18 and the inner wall 22 of the housing main body 17 and, at the same time, the abutting portion 26 of the terminal 16 abuts on the substrate 14.

Figure 3:
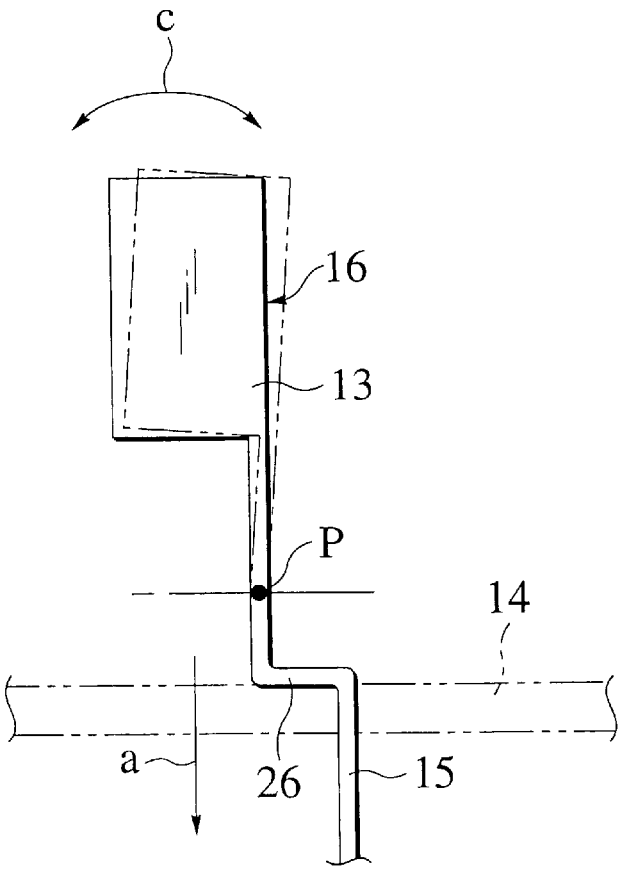
FIG. 3 is a side view showing a state in which a force is applied to a terminal of the substrate connector and the terminal is being bent in this embodiment.

That is, in this embodiment, as shown in FIG. 3, both the contact portion 13 and the soldering fixed portion 15 of the terminal 16 are held between the inner wall 22 of the housing main body 17 and the holding surface 23 of the spacer member 18. In addition, the abutting portion 26 of the terminal 26 abuts on the substrate 14. Owing to this, even if a force indicated by an arrow "a" is applied to the terminal 16, the force is not directly applied to the soldering fixed portion 15.

Moreover, even if a force in a direction along the surface direction of the substrate 14 is applied to the terminal 16, the force is not directly applied to the soldering fixed portion 15 due to the fact that the terminal 16 is held between the holding surface 23 and the inner wall 22 to thereby absorb the force.

In other words, in this embodiment as shown in FIG. 3, since the terminal 16 is held between the contact portion 13 and the soldering fixed portion 15 are held between the inner wall 22 and the holding surface 23, and due to this, even if the terminal portion 13 side is jounced and moved about a fixed point "P" as indicated by an arrow "c", a jounce-inducing force at this time is not directly applied to the soldering fixed portion 15.

The substrate connector 10 in this embodiment can, therefore, ensure preventing defects such as a crack from occurring to the portion where the soldering fixed portion 15 is soldered to the substrate 14.

It is noted that reference numeral 30 shown in FIG. 1B denotes a retaining protrusion retaining the terminal 16 to the interior of the terminal accommodating chamber 11.

Next, description will be given to a substrate connector in the second embodiment according to the present invention with reference to FIGS. 4A, 4B through 6. This embodiment differs from the first embodiment mainly in the constitution of the housing 32 of a substrate connector 31.

Figure 4A:
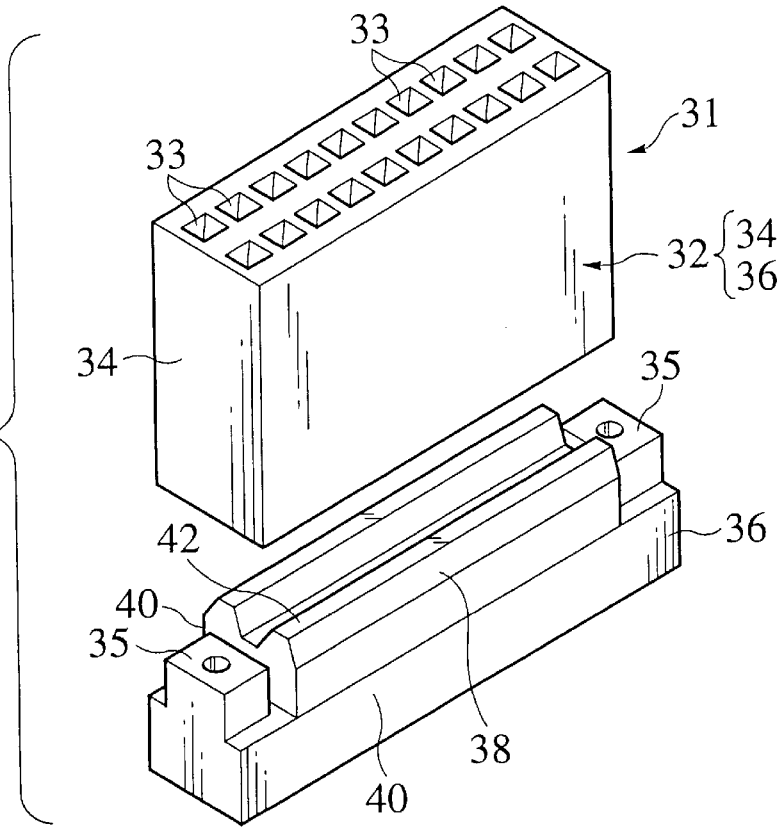
FIG. 4A is a perspective exploded view of a substrate connector in the second embodiment according to the present invention.
Figure 4B:
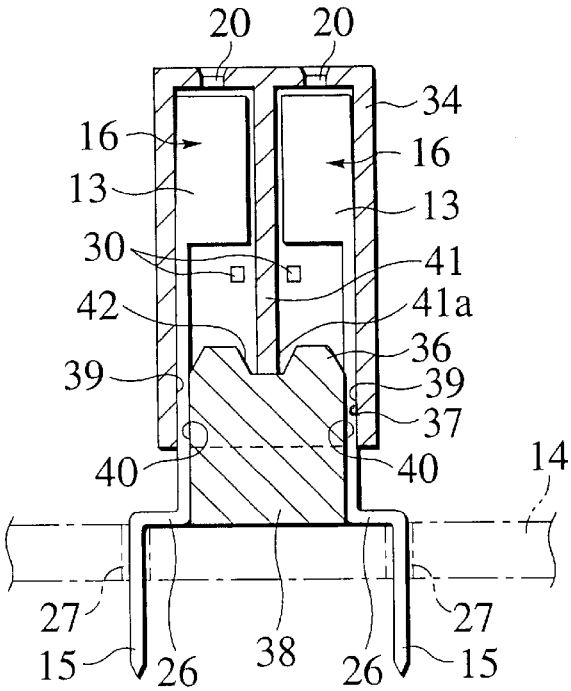
FIG. 4B is a cross-sectional view showing a state in which the substrate connector is fixed onto a substrate in the second embodiment.
Figure 5:
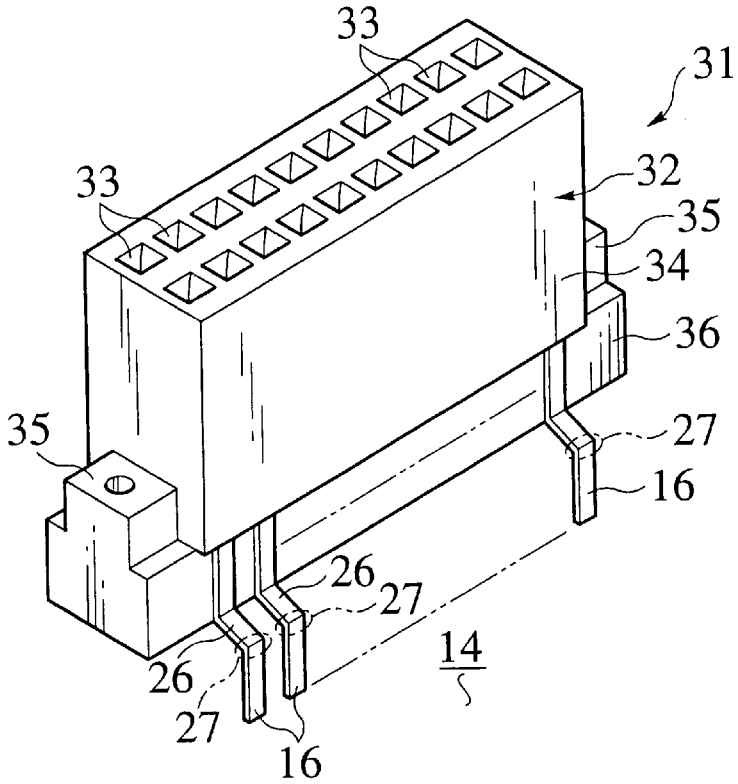
FIG. 5 is a perspective view showing a state in which the substrate connector is fixed onto the substrate in the second embodiment.
Figure 6:
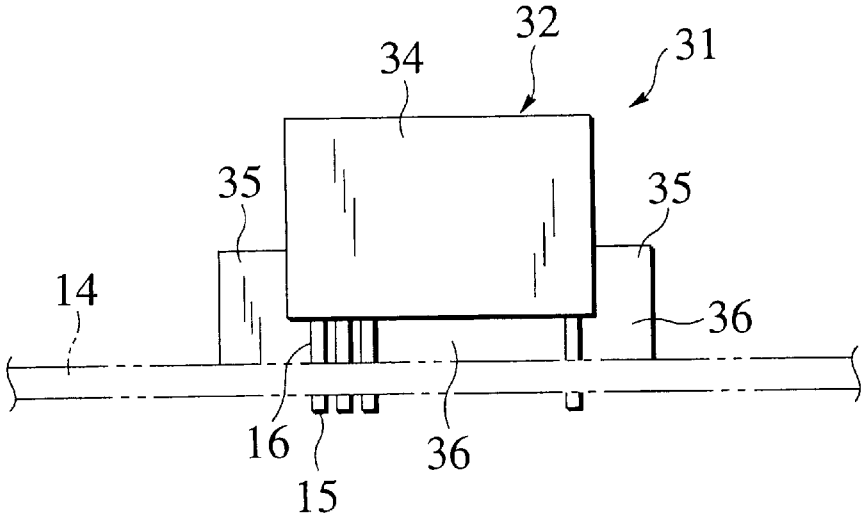
FIG. 6 is a side view showing a state in which the substrate connector is fixed onto the substrate in the second embodiment.
Figure 7:
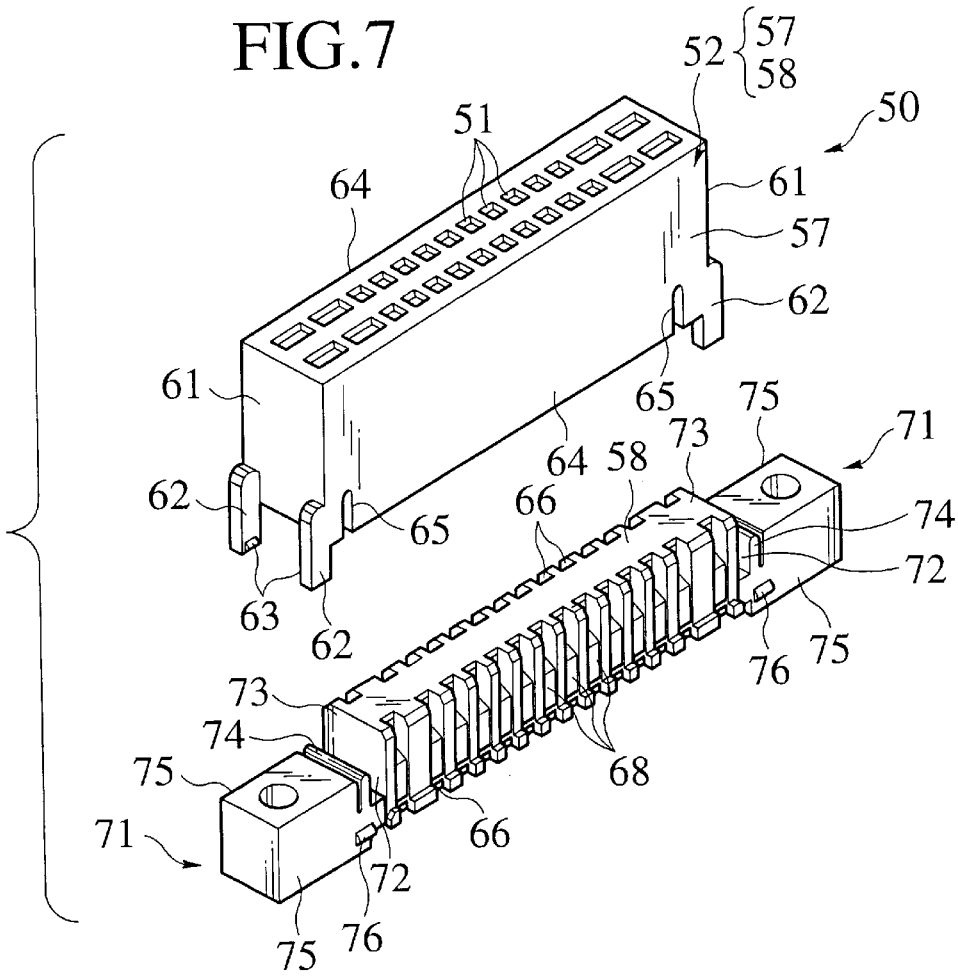
FIG. 7 is a perspective exploded view showing a substrate connector in the third embodiment according to the present invention.

As shown in FIG. 4A, the housing 32 of the substrate connector 31 in this embodiment is provided with a housing main body 34 having a plurality of terminal accommodating chambers 33 partitioned by a partition inner wall 41 into two lines and a spacer member 36 attached and incorporated into the housing main body 34. The spacer member 36 has fixed portions 35 integrally formed therewith and fixed to the substrate 14.

The housing main body 34 corresponds to the structure of the housing main body 17 from both sides of which the fixed portions 21 are removed in the first embodiment. The internal structure of the housing main body 34 is the same as that of the housing main body 17 in the first embodiment.

As for the spacer member 36, the fixed portions 35, 35 fixed to the substrate 14 are integrated into the longitudinal both sides of the spacer member 36, respectively, and a spacer main body 38 inserted into the assembly opening 37 of the housing main body 34 is provided between the fixed portions 35, 35. The lower surface of the spacer main body 38 and the fixed portions 35, 35 on the both sides of the spacer main body 38 is an abutting surface abutting on the substrate 14. Both sides of the spacer main body 38 are holding surfaces 40, 40 for holding a portion between the contact portion 13 and the abutting portion 26 of the terminal 16 between the holding surface 40 and the inner wall 39 of the housing main body 34. An abutting groove 42 against which a lower end portion 41*a* of the partition inner wall 41 partitioning the terminal accommodating chambers 33 of the housing main body 34 abuts is provided on the upper surface of the spacer main body 38 as in the case of the first embodiment.

As shown in FIGS. 4B through 6, while the terminal 16 and the spacer member 36 are incorporated into the housing main body 34, the contact portion 13 is contained in the terminal accommodating chamber 33 and the portion between the abutting portion 26 and the contact portion 13 of the terminal 16 are held between the holding surface 40 of the spacer main body 38 and the inner wall 39 of the housing main body 34. If the fixed portions 35 are fixed onto the substrate 14, each of the abutting portions 26 abuts on the substrate 14 and each of the soldering fixed portions 15 drawn out from the assembly opening 37 of the housing main body 34 passes through the through hole 27 of the substrate 14.

In this stated, the substrate connector 31 is fitted into a mated connector as in the case of the first embodiment, whereby the substrate 14 is electrically connected to a substrate to which the mated connector is directly attached.

At this moment, a force applied to the terminal 16 in a fitting direction (a force in a direction perpendicular to the substrate 14) is not directly applied to the soldering fixed portion 15. This is because the terminal 16 is held between the holding surface 40 of the spacer member 36 and the inner wall 39 of the housing main body 34 and, at the same time, the abutting portion 26 of the terminal 16 abuts on the substrate 14.

Moreover, even if a force in a direction along the surface direction of the substrate 14 is applied to the terminal 16, the force is not directly applied to the soldering fixed portion 15 due to the fact that the terminal 16 is held between the holding surface 40 of the spacer member 36 and the inner wall 39 of the housing main body 34 to thereby absorb the force.

The substrate connector 31 in this embodiment can, therefore, ensure preventing defects such as a crack from occurring to the portion where the soldering fixed portion 15 is soldered to the substrate 14 as in the case of the first embodiment.

Meanwhile, the terminal 16 is provided with the abutting portion 26 cranked between the contact portion 13 and the soldering fixed portion 15 and abutting on the substrate 14. Owing to this, a force applied to the contact portion 13 can be absorbed if the abutting portion 26 abuts onto the substrate 14. It is, therefore, possible to prevent unnecessary load from being applied to the soldering fixed portion 15 and to ensure preventing occurrence of defects such as a crack to the portion where the soldering fixed portion 15 is soldered to the substrate 14.

Further, the spacer member 36 is fixed to the substrate 14 in this embodiment. Due to this, it is possible to fix the spacer member 36 onto the substrate 14 in advance and then to incorporate the terminal 16 temporarily retained by a retaining protrusion 30 into the housing 32. As a result, operability improves during incorporation of the terminal 16 into the housing 32.

Next, description will be given to a substrate connector in the third embodiment according to the present invention with reference to FIGS. 7 through 12. The third embodiment differs from the first embodiment mainly in the constitution of a housing 52 of a substrate connector 50.

As shown in FIGS. 7 through 12, the substrate connector 50 is provided with the housing 52 having a plurality of terminal accommodating chambers 51 formed therein and terminals 56 each contained in each of the terminal accommodating chambers 51 of the housing 52 and each having a contact portion 53 connected to a mated terminal and a soldering fixed portion 55 fixed to a substrate 54 as in the case of the first and second embodiments. The substrate connector 50 is directly attached onto the substrate 54.

The housing 52 is provided with a housing main body 57 having the terminal accommodating chambers 51 partitioned by a partition inner wall 69 into two lines and a spacer member 58 to which the housing main body 57 is assembled.

As for the housing main body 57, an assembly opening 59 from which the soldering fixed portion 55 of the terminal 56 is drawn outside is formed on one side of the housing main body 57, and insertion openings 60 from each of which a mated terminal connected to the terminal 56 is inserted into each of the terminal accommodating chambers 51 are formed on the other side thereof. The housing main body 57 in this embodiment corresponds to the structure of the housing main body 17 in the first embodiment from which the fixed portions 21 on both sides of the main body 17 are removed. The internal structure of the housing main body 57 is the same as that of the housing main body 17 in the first embodiment.

Figure 11:
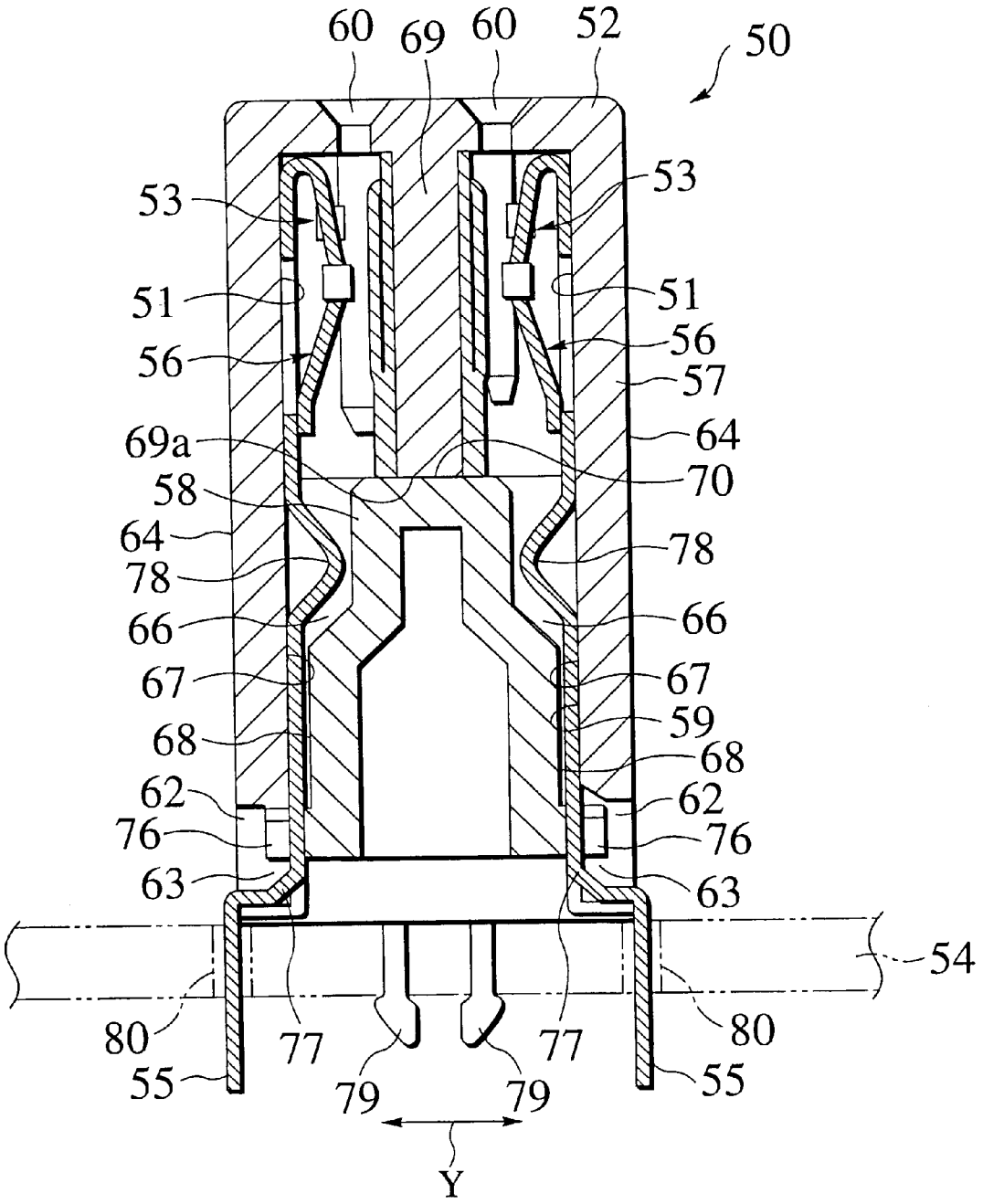
FIG. 11 is a cross-sectional view showing a state in which the substrate connector is fixed onto the substrate in the third embodiment.

A pair of flexible locking arms 62, 62 opposed to each other are provided on each of the lower portions of the longitudinal both side surfaces 61, 61 of the housing main body 57. Locking protrusions 63, 63 opposed to each other are provided on the tip end portions of the paired flexible lock arms 62, 62, respectively. Slits 65, 65 are provided on each of the width-direction side surfaces 64, 64 of the housing main body 57 on the locking arms 62 sides. As shown in FIG. 11, protrusions 79, 79 for temporarily retaining the substrate connector 50 to the substrate 54 are provided on the lower surface of the spacer member 58.

Meanwhile, the spacer member 58 is a substantially rectangular parallelopiped and is provided with a plurality of terminal housing grooves 66 each containing a terminal 56, on both side surfaces thereof. The terminals 56 contained in the terminal housing grooves 66 are held between the inner walls 67, 67 of the terminal accommodating chambers 51, respectively. The bottom surfaces of the terminal housing grooves 66 are terminal holding surfaces 68, 68.

An abutting portion 70, against which a lower portion 69*a* of the partition inner wall 69 partitioning the terminal accommodating chambers 51 within the housing main body 57 abuts, is provided on the upper surface of the spacer member 58. The position at which the spacer member 58 is inserted into the housing main body 57 is determined if the lower end portion 69*a* of the partition inner wall 69 abuts against the abutting portion 70.

Further, fixed portions 71, 71 fixed to the substrate 54 are formed integrally on the longitudinal both sides of the spacer member 58, respectively. Clearances 72, 72 are formed between the fixed portions 71, 71 and the both side surfaces of the spacer member 58, 58, respectively. The both side surfaces 61, 61 of the housing main body 57 are inserted into the clearances 72, 72, respectively. In addition, flexible plates 74, 74 are formed integrally with the fixed portions 71, 71 between the fixed portions 71, 71 and the longitudinal both side surfaces 73, 73 of the spacer member 58, respectively. The flexible plates 74, 74 support the both side surfaces 61, 61 of the housing main body 57 inserted into the clearances 72, 72 between the both side surfaces 73, 73 of the spacer member 58 and the flexible plates 74, 74, respectively. The flexible plates 74, 74 allow the housing main body 57 to move between the fixed portions 71, 71 (in a direction corresponding to an arrow "X" direction in FIGS. 8 and 12).

Figure 12:
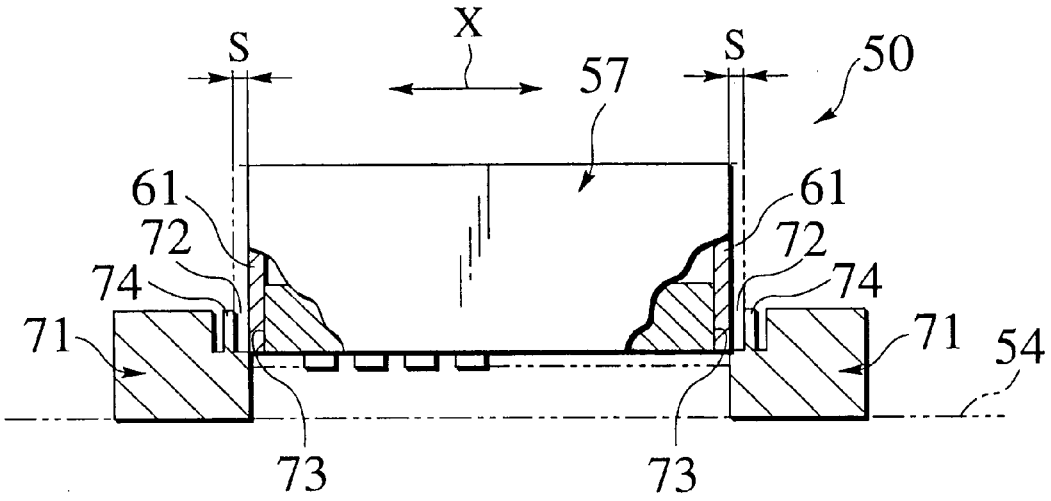
FIG. 12 is a side view showing the relationship between the substrate connector and a mated connector in the third embodiment.

Moreover, retaining protrusions 76, 76 are provided on both side surfaces 75, 75 in a direction (corresponding to an arrow "Y" direction in FIGS. 8 and 11) orthogonal to such a moving direction (corresponding to the arrow "X" direction) in which the housing main body 57 is moved between the fixed portions 71, 71, respectively. Further, the locking protrusions 63, 63 provided at the housing main body 57 are engaged with the retaining protrusions 76, 76 to retain the housing main body 57 to the spacer member 58. At this moment, since the locking arms 62, 62 are flexible, the housing main body 57 is also allowed to move in the direction (corresponding to the arrow "Y" direction) orthogonal to the direction (corresponding to the arrow "X" direction) in which the housing main body 57 moves between the fixed portions 71, 71. It is noted that, even if one side surface 61 of the housing main body 57 abuts against the flexible plate 74, that is, if one distance "S" in FIG. 12 is equal to 0, the housing main body 57 is allowed to move between the fixed portions 71, 71 due to the flexibility of the paired flexible plates 74, 74.

Figure 9:
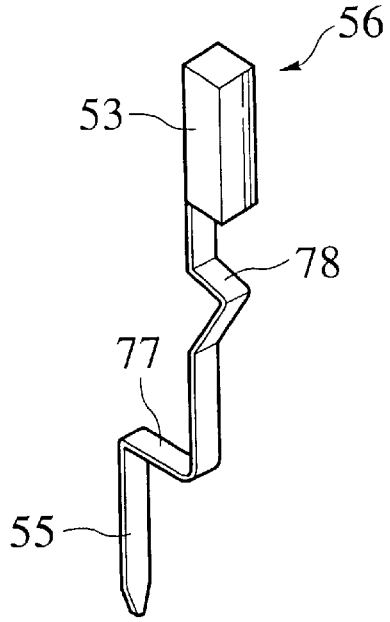
FIG. 9 is a perspective view showing a terminal of the substrate connector in the third embodiment.
Figure 10:
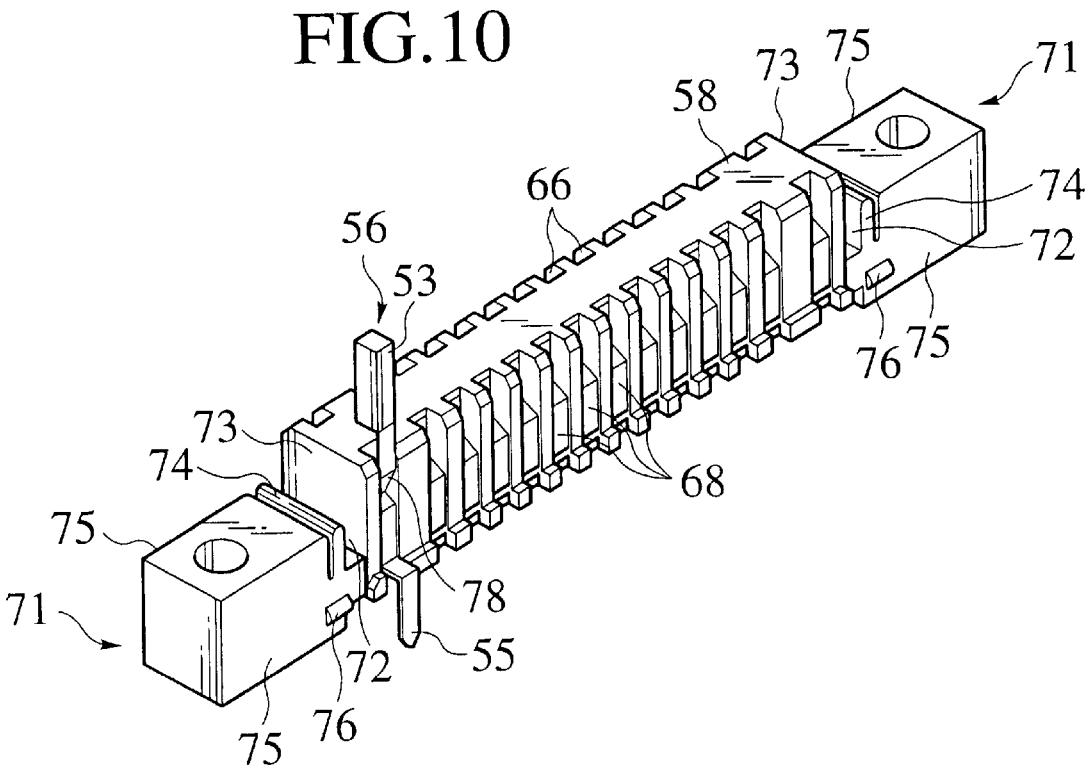
FIG. 10 is a perspective view showing a spacer member of the substrate connector in the third embodiment.

In this embodiment, as shown in FIG. 9, the contact portion 53 contacting with a mated terminal is provided on one side of the terminal 56 and the soldering fixed portion 55 passing through the substrate 54 and fixedly soldered to the back surface of the substrate 54 is provided on the other side of the terminal 56. A bent portion 77, which is cranked, is formed between the contact portion 53 and the soldering fixed portion 55. A V-shaped stress absorbing portion 78 is also formed between the bent portion 77 and the contact portion 53. Moreover, the stress absorbing portion 78 to a portion just before the bent portion 77 are press-fitted into the terminal housing groove 66 of the spacer member 58 and held between the inner wall 67 of the housing main body 57 and the terminal holding surface 68 of the spacer member 58.

As shown in FIG. 11, while the terminals 56 and the spacer member 58 are incorporated into the housing main body 57, the contact portions 53 are contained in the terminal accommodating chambers 51, respectively. A portion between the contact portion 53 and a portion just before the bent portion 77 are press-fitted into the terminal accommodating chamber 66 of the spacer member 58 and is held between the inner wall 67 of the housing main body 57 and the terminal holding surface 68 of the spacer member 58. In addition, if the fixed portions 71, 71 are fixed to the substrate 54 by use of screws, respectively, the soldering fixed portion 55 side drawn out from the assembly opening 59 of the housing main body 57 is inserted into a through hole 80 of the substrate 54. The soldering fixed portion 55 inserted into the through hole 80 is fixedly soldered to the back surface of the substrate 54.

Figure 8:
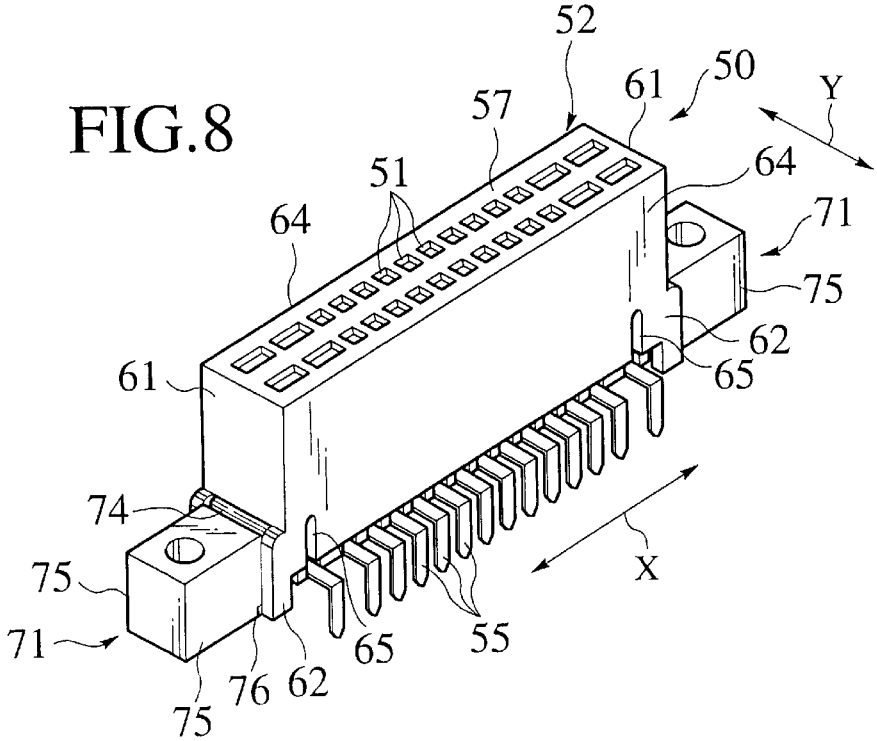
FIG. 8 is a perspective view showing a state in which the substrate connector is fixed onto a substrate in the third embodiment.

Now, while the spacer member 58 is incorporated into the housing main body 57, the both side surfaces 61, 61 of the housing main body 57 are inserted into the clearances 72, 72, and inserted between the flexible plates 74, 74 and the side surfaces 73, 73 of the spacer member 58, respectively, as shown in FIG. 8. The locking arms 62, 62 hold the fixed portions 71 therebetween and the locking protrusions 63 are engaged with the retaining protrusions 76, respectively.

In this state, the substrate connector 50 and a mated connector are fitted together, to thereby electrically connect the terminals of the mated connector to the substrate 54.

At this moment, even if the mated connector is shifted from a normal fitting position, the substrate connector 50 can be smoothly fitted into the mated connector. This is because the housing main body 57 is movable in the "X" and "Y" directions with respect to the spacer member 58 and is movable toward the shifted mated connector.

Here, a force applied to the terminal 56 in the fitting direction (a force in a direction perpendicular to the substrate 54) is not directly applied to the soldering fixed portion 55 due to the fact that the terminal 56 is provided with the stress absorbing portion 78 and, at the same time, the terminal 56 is held between the terminal holding surface 68 of the terminal housing groove 66 of the spacer member 58 and the inner wall 67 of the housing main body 57.

Furthermore, even if a force in a direction along the surface direction of the substrate 54 is applied to the terminal 56, the force is not directly applied to the soldering fixed portion 55. This is because the terminal 56 is held between the terminal holding surface 68 of the terminal housing groove 66 of the spacer member 58 and the inner wall 67 of the housing main body 57, to thereby absorb the force.

In other words, in this embodiment, since the terminal 56 is provided with the stress absorbing portion 78 and, at the same time, held between the terminal holding surface 68 of the terminal housing groove 66 and the inner wall 67, the force applied to the terminal 56 in the fitting direction (the force in a direction perpendicular to the substrate 54) is not directly applied to the soldering fixed portion 55.

Meanwhile, in this embodiment, since the portion between the contact portion 53 and the soldering fixed portion 55 of the terminal 56 is held between the inner wall 67 and the holding surface 68, due to this, even if the contact portion 53 is jounced about the fixed point positioned between the inner wall 67 and the holding surface 68, the jounce-induced force is not directly applied to the soldering fixed portion 55.

Hence, in this embodiment as in the case of the preceding embodiments, it is possible to ensure preventing occurrence of defects such as a crack to the portion where the soldering fixed portion 55 is soldered to the substrate 54.

Moreover, in this embodiment, the side surfaces 61, 61 of the housing main body 57 are inserted into the clearances 72, 72 on both sides of the spacer member 58, respectively, as shown in FIG. 12. Owing to this, the housing main body 57 is allowed to move between the fixed portions 71, 71, and the jounce as indicated by "S" in the "X" direction of the housing main body 57 can be thereby absorbed.

Furthermore, due to the flexibility of the locking arms 62, 62, the housing main body 57 is also allowed to move in the "Y" direction.

Hence, when the substrate connector 50 and the mated connector are fitted together, the housing main body 57 can move in either direction in cooperation with the elasticity of the terminal 56, thereby making it possible to preferably align the housing main body 57.

What is claimed is:

1. A substrate connector comprising:

a terminal including a contact portion contacting [with] a mated terminal and a fixed portion fixed to a substrate; and a housing including a housing main body and a spacer member, the housing main body including a first opening portion which is provided on one side of the housing main body and from which the fixed portion of the terminal is led outside, a second opening portion which is provided on the other side of the housing main body and into which the mated terminal is inserted, and a terminal accommodating chamber accommodating both of the terminal and the mated terminal and provided between the first opening portion and the second opening portion, and the spacer member being attached to the first opening portion of the housing main body, wherein the terminal is held in the housing by sandwiching a portion of the terminal between the spacer and an inner wall of the terminal accommodating chamber.

2. A substrate connector according to claim 1, wherein the fixed portion of the terminal is to be fixed by a solder.

3. A substrate connector according to claim 1, wherein the housing main body includes fixed portions each of which is fixed to the substrate on each of both sides of the housing main body.

4. A substrate connector according to claim 3, wherein each of the fixed portions of the housing main body is provided on each of longitudinal both sides of the housing main body.

5. A substrate connector according to claim 1, wherein the spacer member includes fixed portions each of which is fixed to the substrate on each of both sides of the spacer member.

6. A substrate connector according to claim 5, wherein each of the fixed portions of the spacer member is provided on each of longitudinal both sides of the spacer member.

7. A substrate connector according to claim 5, wherein the spacer member includes a pair of flexible plate portions each of which supports corresponding one of both sides of the housing main body, while allowing the housing main body to move in a direction connecting each of the fixed portions of the spacer member.

8. A substrate connector according to claim 5, wherein the spacer member includes a pair of protrusions corresponding to each of the fixed portions of the spacer member, and the housing main body includes a pair of protrusions correspondingly locked by the pair of protrusions of the spacer member and a pair of flexible locking arm portions each of which is provided with one of the protrusions of the housing main body, the pair of flexible locking arm portions allowing the housing main body to move in a direction crossing a direction connecting each of the fixed portions of the spacer member.

9. A substrate connector according to claim 8, wherein the direction crossing the direction connecting each of the fixed portions of the spacer member is a direction substantially orthogonal to the direction connecting each of the fixed portions of the spacer member.

10. A substrate connector according to claim 8, wherein each of the pair of flexible plate portions of the spacer member is formed integrally with corresponding one of the fixed portions of the spacer member so as to be opposed to corresponding one of longitudinal side surfaces of the housing main body, the pair of the protrusions of the spacer member are provided to each of the fixed portions on both sides in the direction crossing the direction connecting each of the fixed portions of the spacer member, the pair of flexible locking arm portions of the housing main body are provided on each of the longitudinal side surfaces of the housing main body so as to be opposed to each other on both sides of the spacer member in the direction crossing the direction connecting each of the fixed portions of the spacer member, and one of the protrusions of the housing main body is provided at each of the pair of flexible locking arm portions so as to be opposed to corresponding one of the protrusions of the housing main body.

11. A substrate connector according to claim 1, wherein the housing main body includes an inner wall portion positioning the spacer member attached into the housing main body.

12. A substrate connector according to claim 1, wherein the terminal includes an abutting portion abutting on the substrate, the abutting portion being formed by bending the terminal between the contact portion thereof and the fixed portion thereof.

* * * * *